United States Patent [19]

Rudolf et al.

[11] 4,392,311

[45] Jul. 12, 1983

[54] EXPANDABLE OVERSHOE

[76] Inventors: Warren P. Rudolf; Susan A. Rudolf, both of 8210 Brandon Dr., Millersville, Md. 21108

[21] Appl. No.: 289,764

[22] Filed: Aug. 3, 1981

[51] Int. Cl.[3] ..... A43B 1/10; A43B 11/00

[52] U.S. Cl. ..... 36/7.3; 36/50

[58] Field of Search ..... 36/50, 7.3, 4

[56] References Cited

U.S. PATENT DOCUMENTS

| | | | |
|---|---|---|---|
| 1,088,067 | 2/1914 | Forbes | 36/50 |
| 1,114,435 | 10/1914 | Batten | 36/50 |
| 2,108,650 | 2/1938 | Casey | 36/7.3 |
| 3,645,017 | 2/1972 | Hickmann | 36/120 |
| 3,879,865 | 4/1975 | Kimball | 36/7.3 |

*Primary Examiner*—Patrick D. Lawson

*Attorney, Agent, or Firm*—James J. Brown

[57] ABSTRACT

An overshoe is provided having improved means for facilitating its being put on or taken off, especially over bulky or unusually shaped footwear. The overshoe is provided with opposing apertures on either side of the ankle, extending from almost the heel, vertically to the top of the ankle of the overshoe. These apertures are closed by appropriate fasteners, such as slide type fasteners, which are attached to expandable flaps so that the entire ankle portion of the overshoe can adapt to bulky footwear. When the overshoe is unfastened, the rear portion of the ankle of the overshoe serves as a convenient grip to facilitate putting on or taking off of the overshoe. The overshoe is particularly adapted to be worn over orthopedic type shoes.

7 Claims, 4 Drawing Figures

8
11
14
10
13
9

7
8
11
12
10
13
9
5
6
2
1
3
4

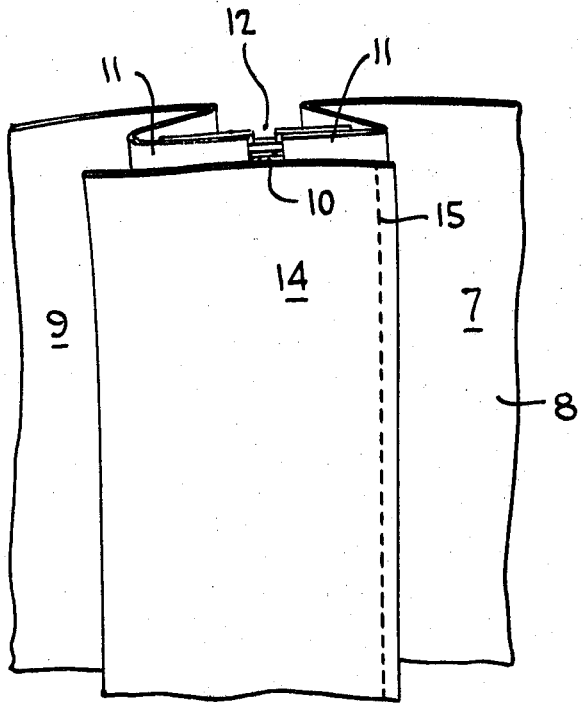
FIG. 3
FIG. 4
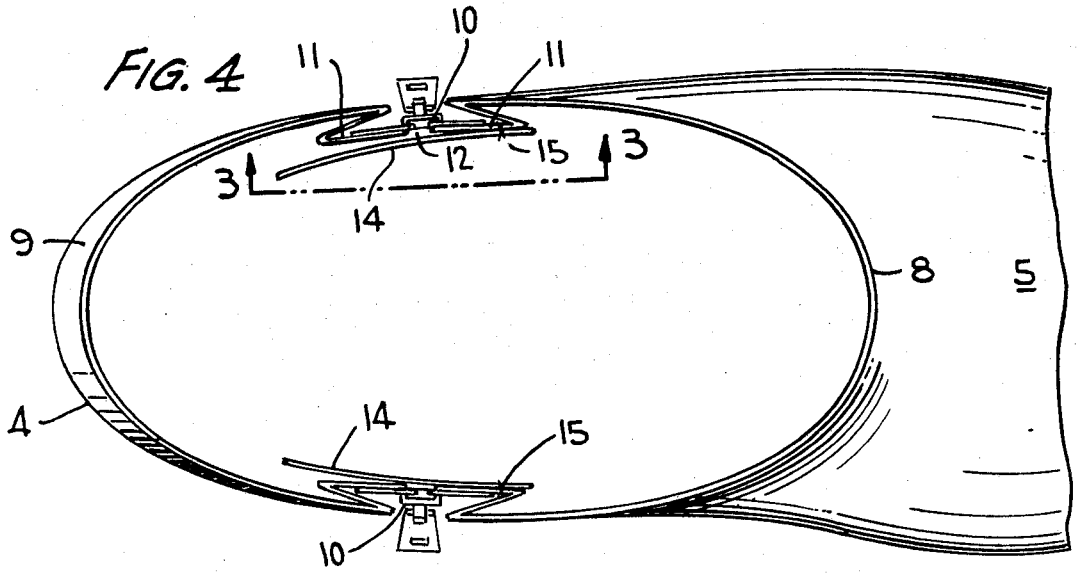

EXPANDABLE OVERSHOE

SUMMARY OF THE INVENTION

The present invention is directed to an overshoe adapted to facilitate putting on or taking off the overshoe over other footwear. The invention is particularly directed to an overshoe which is adapted to be worn over particularly bulky footwear such as orthopedic shoes and which is constructed in a way to permit the overshoe to fit over such footwear with ease and comfort.

BACKGROUND OF THE INVENTION

Overshoes, particularly those having the configuration of boots, have been known in the art for a considerable period of time and have been constructed of various materials and in various configurations. One of the problems which has frequently been associated with overshoes which are intended to be worn over other footware is that such overshoes can often be difficult to put on and take off. Most users of such footwear are for example familiar with the frequent instance where the wearer's shoe stays in the overshoe when it is attempted to remove the overshoe. Others may be familiar with the difficulty in putting on overshoes when for example the primary shoe is damp or made of a material which does not slip readily into an out of the overshoe.

The difficulty in making a well fitting overshoe of such construction that it is exceptably easy to get into and out of has resulted in overshoes being made of highly elastic materials and with various closures being provided usually on the front of the overshoe so that they can be unzipped. While these approaches have to some extent been successful in facilitating the use of such overshoes in connection with ordinary footwear, little has been done to facilitate the use of overshoes with types of primary footwear which are of unusual or bulky configuration and which are therefore particularly difficult to either put on or take off. It can, for example, be particularly difficult if not impossible to use most types of overshoes with orthopedic shoes or boots which have configurations somewhat different than the "ordinary" shoe.

It is accordingly an object of the present invention to provide an overshoe having a unique construction which facilitates its being worn over shoes or boots of particularly bulky or unusual configuration, especially orthopedic shoes and boots.

It is another object of the present invention to provide an overshoe which can readily and easily be put on or taken off over a primary shoe or boot, particularly a shoe or boot having an unusual or bulky configuration.

BRIEF DESCRIPTION OF THE DRAWINGS

FIG. 3 is a side view of the inside of the ankle portion of the upper of the overshoe of the invention.

FIG. 4 is a top view of the ankle portion of the overshoe of the invention.

DESCRIPTION OF THE INVENTION

The objectives of the present invention are achieved by providing an overshoe, preferably made of elastic construction, which is provided with two opposing longitudinal apertures which extend vertically on either side of the ankle portion of the overshoe from just above the heel to the top of the ankle. These apertures permit both the forward and back sections of the ankle portion of the overshoe to be turned back when the boot is being either placed on or taken off of the primary shoe. The back section of the overshoe also provides, when it is turned back, a convenient means for grasping the overshoe from the rear to facilitate putting it on or removing it. The respective opposing apertures are each closed by appropriate closure means once the overshoe is on. These closure means for example may be slide fasteners or snaps which extend essentially the full length of the aperture.

In order to permit expansion of the ankle portion of the overshoe, for example to accommodate bulky footwear, an expansible, flexible flap is provided on each side of the aperture extending essentially the length of the aperture and joined to the opposing flap by one of the closure means used to close the ankle portion of the overshoe. An additional flap of flexible material can also be attached to one side of each aperture and also extends essentially the length of the aperture inside of the expandible flap and closure to provide a waterproof barrier when the overshoe is closed. This additional flap of material should therefore be of sufficient width to at least overlap the closure means.

The overshoe of the present invention can be constructed of various materials known in the art and appropriate to such footwear. Clearly, it is desirable that the material of which the overshoe is made be waterproof and flexible. The uppers may, for example, be constructed of rubber or polymeric material such as vinyl, either with or without backing or lining. Similarly, the bottom portion or sole of the overshoe may be constructed of the same material or of any of the commonly used materials for making soles of footwear although again it is most desirable that this material be of a waterproof nature and capable of being bonded in a waterproof manner to the upper portion of the overshoe.

Further details of the present invention will, however, become apparent by having reference to the drawings.

Figure 1:
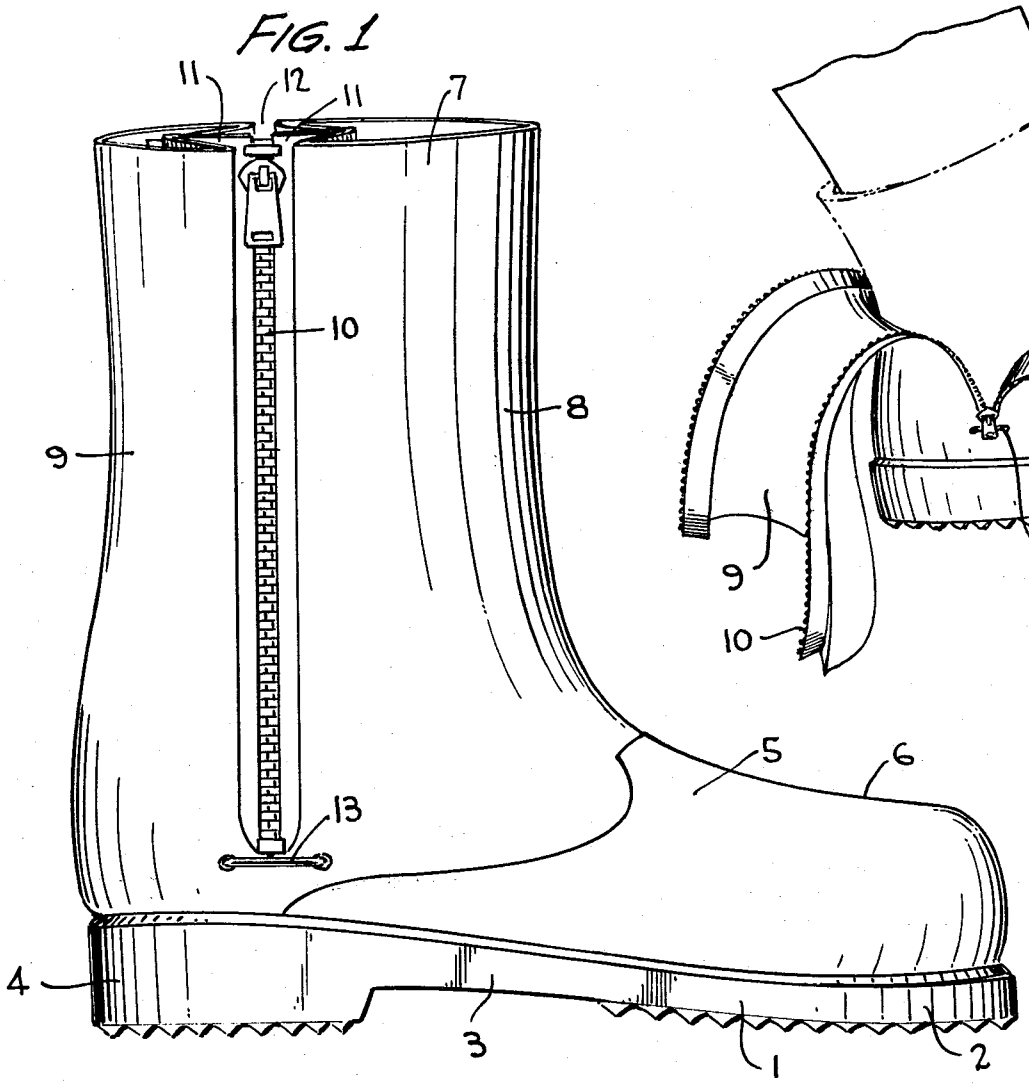
FIG. 1 is a side view of the complete overshoe of the present invention.

FIG. 1 illustrates a side view of the overshoe of the present invention in which the sole 1 has a toe portion 2, an arch portion 3, and a heel portion 4. An upper 5 is attached to the sole and comprises a toe section 6 and an ankle section 7 attached to the toe section 6 and the sole. It will of course be understood that it is within the contemplation of the present invention that the entire upper 5 may be of a single piece construction. The upper 7 is divided into a forward section 8 and a back section 9 by the aperture 12 extending from the top of the ankle portion to almost the heel. A similar aperture divides the other side (not shown) of the ankle portion of the overshoe. Closure of the aperture 12 is provided by closure means 10 which may be a slide fastener as shown in the illustration. The slide fastener 10 is attached to two expandable flaps 11 each of which is attached to an opposing side of the aperture 12 and extends essentially the full length of the aperture. This expandable flap permits the ankle portion of the overshoe to expand, as required, to accommodate bulky or unusually shaped primary footwear. Reinforcement 13 is provided at the bottom of each aperture to prevent tearing of the ankle portion of the overshoe and alleviate stress when the overshoe is being put on or taken off. This reinforcement may consist, for example, of a brad or multiple layers of material to strengthen that portion of the overshoe.

Figure 2:
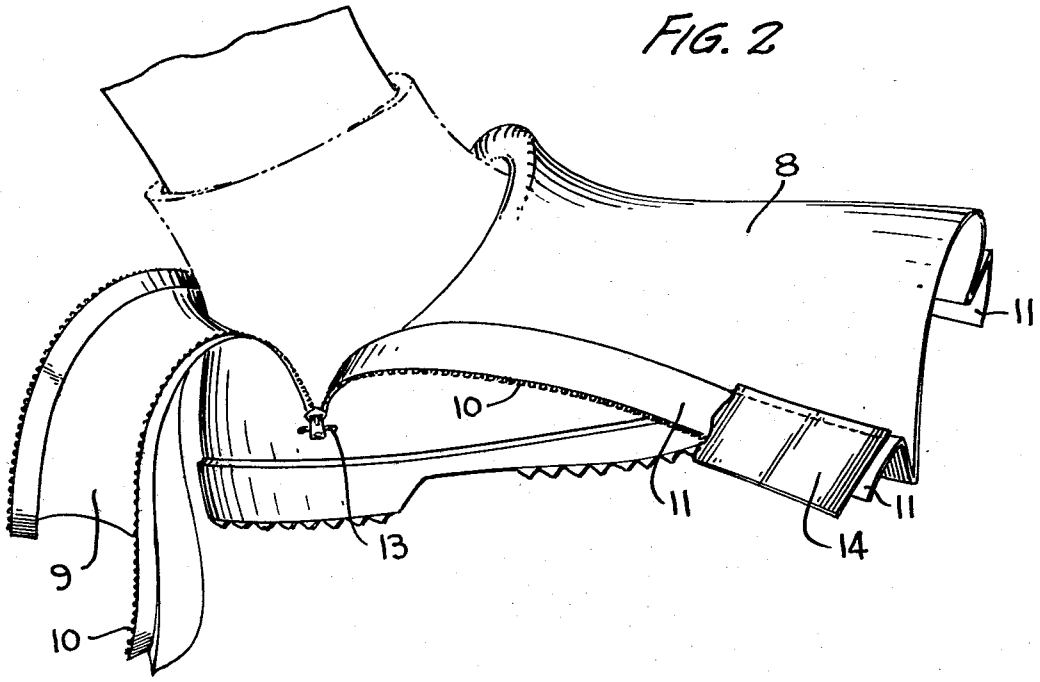
FIG. 2 is a view of the overshoe of the present invention when opened to facilitate its being put on or taken off.

FIG. 2 illustrates the overshoe of the present invention when the respective closures on either side of the ankle portion are opened to permit the overshoe be put on or taken off. The primary shoe and ankle of the wearer are shown in phantom within the opened overshoe. It can also be seen that the back section 9 of the ankle portion can be turned down as can the front section 8 and that the back section 9 thereby also provides a convenient means for grasping the back of the overshoe to facilitate its being put on or taken off. In part to alleviate the stress which results from pulling on the back section 9, the reinforcement 13 is provided at the bottom of the aperture 12.

FIG. 3 illustrates the inside of the ankle portion of the overshoe. It will be noted that on either side of the aperture 12, expandable flaps 11 are provided which are essentially of accordian configuration and extend the full length of the aperture. Attached to one of the expandable flaps 11 at 15 is an additional flap 14 which overlaps the aperture and the expandable flaps 11 to provide a waterproof barrier. This flap should, of course, be large enough to overlap and provide this waterproof barrier even when the side of the ankle portion of the boot is expanded.

FIG. 4 is a top view of the ankle portion of the overshoe of the present invention. The apertures 12 are shown on either side of the ankle portion, both said apertures being provided on either side by expandable flaps 11 which are joined in the closed configuration by the closures 10 which may be slide fasteners as shown in the drawing. Attached to one of each pair of the expandable flaps is the waterproof barrier flap 14 which extends the length of the aperture and the expandable flap. This waterproof flap is of sufficient width to prevent egress of moisture through the closure 10.

Although, the overshoe of the present invention is specifically adapted for use with orthopedic shoes and boots and is intended to provide footwear protection which is more easily used by the wearers of such shoes and boots, it will also be apparent that the overshoe of the present invention can advantageously be used and worn in conjunction with other types of primary footwear or, by those whose feet may be deformed or require special applications such as bandages. The overshoe of the present invention finds particular application in view of the ease by which it may be put on or taken off and the expandable characteristics which it possesses. It will of course be apparent that the scope of the present invention is not considered to be limited to the embodiment specifically illustrated herein by way of illustration.

We claim:

1. An overshoe comprising a sole having toe, arch, and heel portions and an upper secured to said sole, said upper comprising a forward portion extending from about said arch portion of the sole to the end of the toe and an ankle portion of flexible material extending from about said arch portion to the end of the heel portion and upward to below the knee of the wearer, said ankle portion being divided into front and back sections by two opposing longitudinal apertures each extending vertically on either side of said ankle portion from just about said heel portion to the top of said ankle portion to facilitate putting on or taking off the overshoe, each of said apertures being adapted to be closed by respective closure means extending the length thereof; the back section of said ankle portion being adapted when the apertures are open to provide means for grasping said overshoe from the rear further to facilitate pulling it on or removing it.

2. The overshoe of claim 1 wherein said closure means are slide fasteners.

3. The overshoe of claim 1 wherein each of said apertures is provided on each side with an opposing flexible, expandible flap, extending essentially the length of said aperture and joined to the opposing flap by one of said closure means.

4. The overshoe of claim 3 wherein an additional flap of flexible material is attached on one side of each aperture extending essentially the length of said aperture inside of said expandible flap and closure means, and of sufficient width to at least overlap said closure means.

5. The overshoe of claim 1, wherein reinforcing means is provided on said ankle portion immediately below the lower terminus of each of said apertures and above the heel.

6. The overshoe of claim 1 which is specifically adapted to fit over an orthopedic shoe or boot.

7. The overshoe of claim 1 wherein both the front and back sections of said ankle portion are adapted to be turned down to facilitate putting on or removing the overshoe.

* * * * *